US011794795B2

(12) United States Patent
Brest

(10) Patent No.: US 11,794,795 B2
(45) Date of Patent: Oct. 24, 2023

(54) METHOD OF RECONDITIONING A RAILCAR COUPLER

(71) Applicant: A. Stucki Company, Moon Township, PA (US)

(72) Inventor: Robert Brest, Naperville, IL (US)

(73) Assignee: A. Stucki Company, Moon Township, PA (US)

( * ) Notice: Subject to any disclaimer, the term of this patent is extended or adjusted under 35 U.S.C. 154(b) by 0 days.

(21) Appl. No.: 17/667,945

(22) Filed: Feb. 9, 2022

(65) Prior Publication Data

US 2022/0250664 A1 Aug. 11, 2022

Related U.S. Application Data

(60) Provisional application No. 63/147,276, filed on Feb. 9, 2021.

(51) Int. Cl.
*B61G 1/28* (2006.01)
*B61K 11/00* (2006.01)

(52) U.S. Cl.
CPC ..... *B61K 11/00* (2013.01); *B61G 1/28* (2013.01)

(58) Field of Classification Search
CPC . B61K 11/00; B61G 1/28; B61G 7/14; B61G 7/00; B61G 3/04; G01B 3/22; G01B 3/14; B23K 37/00
See application file for complete search history.

(56) References Cited

U.S. PATENT DOCUMENTS 10,207,722 B2 2/2019 Berg et al.
2003/0037422 A1* 2/2003 Brueckert ..... B61G 7/00 29/402.18
2009/0294396 A1 12/2009 Smerecky et al.
2010/0024232 A1* 2/2010 Saeler ..... B61G 7/14 33/546
2011/0197461 A1 8/2011 Saeler
2013/0206742 A1* 8/2013 Brueckert ..... B23K 37/00 219/136
2013/0213921 A1* 8/2013 Smerecky ..... B61G 3/04 228/103

FOREIGN PATENT DOCUMENTS

WO WO-2011094119 A1 * 8/2011 ..... B61G 3/04

OTHER PUBLICATIONS

International Search Report for PCT/US2022/015744 dated Apr. 28, 2022.
Written Opinion of the International Searching Authority for PCT/US2022/015744 dated Apr. 28, 2022.

* cited by examiner

*Primary Examiner* — Lee A Holly
(74) *Attorney, Agent, or Firm* — Buchanan Ingersoll & Rooney PC

(57) ABSTRACT

A method for reconditioning a railcar coupler is disclosed, including determining, using a gauge, an amount of wear to a coupler pulling lug; cleaning a surface of the coupler pulling lug experiencing the wear; and applying a weldment to the surface of the coupler pulling lug experiencing the wear to increase the thickness of the coupler pulling lug. The amount of weldment applied to the coupler pulling lug is preferably equal to the amount of wear experiencing by the coupler pulling lug to bring the thickness of the coupler pulling lug back to its original thickness or very close thereto.

14 Claims, 8 Drawing Sheets

METHOD OF RECONDITIONING A RAILCAR COUPLER

CROSS-REFERENCE TO RELATED APPLICATIONS

This patent application claims the benefit of and priority to U.S. Provisional Patent Application No. 63/147,276, filed on Feb. 9, 2021, the entire contents of which is incorporated by reference in its entirety.

FIELD OF THE INVENTION

The present disclosure relates to a method of reconditioning a railcar coupler and, more particularly, to a method of reconditioning a railcar coupler for improved loading and longer coupler life.

BACKGROUND OF THE INVENTION

A railcar coupler is a device that is positioned at or near each end of a railcar. Couplers are typically attached to a yoke mounted on the center sill of the railcar. Couplers are centrally located and will face the coupler of an adjacent railcar. When it is desired to couple a railcar to another railcar, one of the railcars is advanced towards the other to generate an impact coupling event—two couplers engage and connect to each other to join the two railcars together. This is known as a buff event. When a locomotive causes the railcars (after they have been coupled to each other) to move for transporting the railcars, a pulling force is exerted on each coupler. This is known as a draft event. During travel, the railcar coupler experiences buff and draft events. Railcar couplers are subject to very large forces and eventually need to be reconditioned or replaced.

Each coupler carries a knuckle thereon that is pivotally mounted via a pin extending through a pin protector. The knuckle operates with other elements (e.g., knuckle lock, knuckle thrower, knuckle lock lift, etc.) to receive and engage with a knuckle on an adjacent coupler to connected and disconnect the railway cars to and from each other. In general, the knuckle is pivotable between locked and unlocked positions. (See FIG. 7).

The knuckle and coupler are designed to have small tolerances between engaging components so that proper loading occurs, especially when the train is in draft. The coupler includes top and bottom pulling lugs, which are designed to be loaded first during a draft event before any other interface of the knuckle and coupler.

During draft events, the top and bottom lugs of the knuckle will engage the top and bottom pulling lugs of the coupler. With a new coupler, the gaps between the top and bottom lugs of the knuckle and the top and bottom pulling lugs of the coupler will be close to zero. The gaps between the pin and pin hole and the pin protector and knuckle will be large, and may be in or around ⅛-inch. This results in the knuckle pulling on the pulling lugs when the train is in draft, which is desired for improved coupler life.

As the pulling lugs wear, the gaps between the coupler pulling lugs and the knuckle lugs become larger than the gaps between the other interfaces. This results in the knuckle pulling on the pin and/or pin protector, which is not desirable as it results in uneven loading and faster coupler failure. The pin and pin protector are not designed to withstand the same loading as the coupler pulling lugs and will eventually break resulting in coupler failure.

Current methods of reconditioning railcar couplers do not address the wear of the coupler pulling lugs. Thus, when a coupler is reconditioned, the gap between the coupler pulling lugs and the knuckle lugs will still be greater than the gaps between the other coupler/knuckle interfaces. During a draft event, loading, which was originally was designed to be exerted on the pulling lugs, will occur at the other coupler/knuckle interfaces (e.g., at the pin and/or pin protector). Such uneven loading, even with a reconditioned coupler, will result in reduced coupler life.

The present disclosure is directed toward overcoming one or more of the above-mentioned problems, though not necessarily limited to embodiments that do.

SUMMARY OF THE INVENTION

A method for reconditioning a railcar coupler is disclosed, including determining, using a gauge, an amount of wear to a coupler pulling lug; cleaning a surface of the coupler pulling lug experiencing the wear; and applying a weldment to the surface of the coupler pulling lug experiencing the wear to increase the thickness of the coupler pulling lug. The amount of weldment applied to the coupler pulling lug is preferably equal to the amount of wear experiencing by the coupler pulling lug to bring the thickness of the coupler pulling lug back to its original thickness or very close thereto.

An exemplary embodiment of a method for reconditioning a railcar coupler involves determining, using a gauge, an amount of wear to a coupler pulling lug. The method involves cleaning a surface of the coupler pulling lug experiencing the wear. The method involves applying a weldment to the surface of the coupler pulling lug experiencing the wear to increase the thickness of the coupler pulling lug.

In some embodiments, the amount of weldment applied to the coupler pulling lug is equal to the amount of wear experienced by the coupler pulling lug.

In some embodiments, the railcar coupler includes a coupler top pulling lug and a coupler bottom pulling lug. The method involves determining, using a gauge, an amount of wear to the coupler top pulling lug and an amount of wear the coupler bottom pulling lug. The method involves cleaning a surface of the coupler top pulling lug experiencing the wear. The method involves cleaning a surface of the coupler bottom pulling lug experiencing the wear. The method involves applying weldment to the surface of the coupler top pulling lug experiencing the wear to increase the thickness of the coupler top pulling lug. The method involves applying weldment to the surface of the coupler bottom pulling lug experiencing the wear to increase the thickness of the coupler bottom pulling lug.

In some embodiments, the method involves grinding the weldment applied to the coupler pulling lug.

In some embodiments, the method involves grinding the weldment applied to the coupler pulling lug so that a profile of the coupler pulling lug complements a profile of a knuckle lug.

In some embodiments, the method involves heat treating the weldment applied to the coupler pulling lug.

In some embodiments, the method involves using a gauge to assess whether the weldment applied increases the thickness to an amount less than, equal to, or greater than the wear experienced by the coupler pulling lug. In some embodiments, the gauge comprises a mandrel structure, a spindle, and a measurement element. The method involves inserting the gauge into the railcar coupler so that the spindle inserts into a pin protector of the railcar coupler. The method involves rotating the gauge so that the measurement element traverses an arc path across the coupler pulling lug.

In some embodiments, the method involves using a gauge to determine the amount of wear to a coupler pulling lug. In some embodiments, the gauge comprises a mandrel structure, a spindle, and a measurement element. The method involves inserting the gauge into the railcar coupler so that the spindle inserts into a pin protector of the railcar coupler. The method involves rotating the gauge so that the measurement element traverses an arc path across the coupler pulling lug.

In some embodiments, the method involves using a distance between the measurement element and the coupler pulling lug as an indicator of the amount of wear experienced by the coupler pulling lug.

In some embodiments, the method involves removing the gauge before applying weldment; or rotating the measuring element so as to not be adjacent to the surface of the coupler pulling lug experiencing the wear before applying weldment.

In some embodiments, the measuring element includes a fixed length rod or a dial rod having an adjustable length.

In some embodiments, the measuring element includes guide plate, the guide plate being an arcuate member.

Additional features, aspects, objects, advantages, and possible applications of the present disclosure will become apparent from a study of the exemplary embodiments and examples described below, in combination with the Figures and the appended claims.

DETAILED DESCRIPTION OF THE INVENTION

The following description is of exemplary embodiments that are presently contemplated for carrying out the present invention. This description is not to be taken in a limiting sense, but is made merely for the purpose of describing the general principles and features of various aspects of the present invention. The scope of the present invention is not limited by this description.

Figure 1:
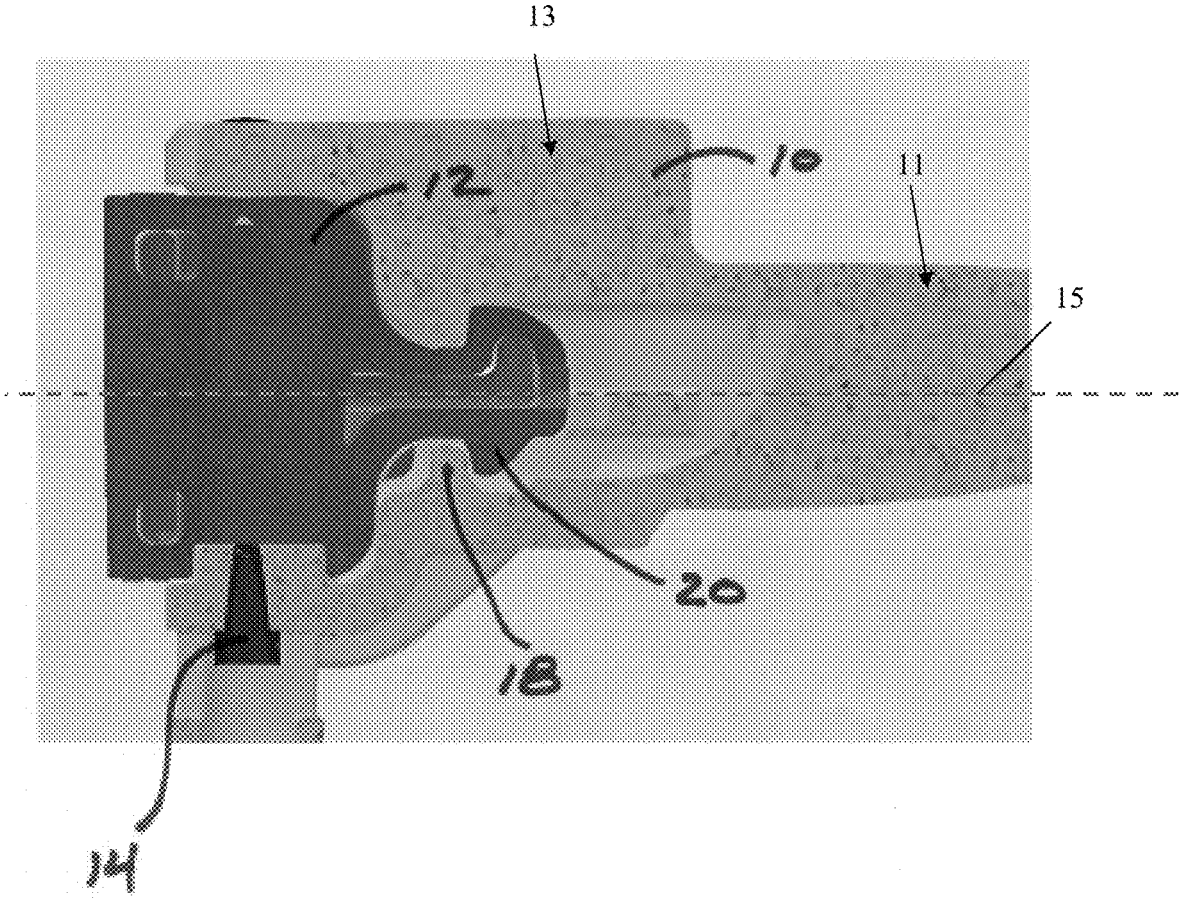
FIG. 1 shows a typical unworn bottom pulling lug.
Figure 2:
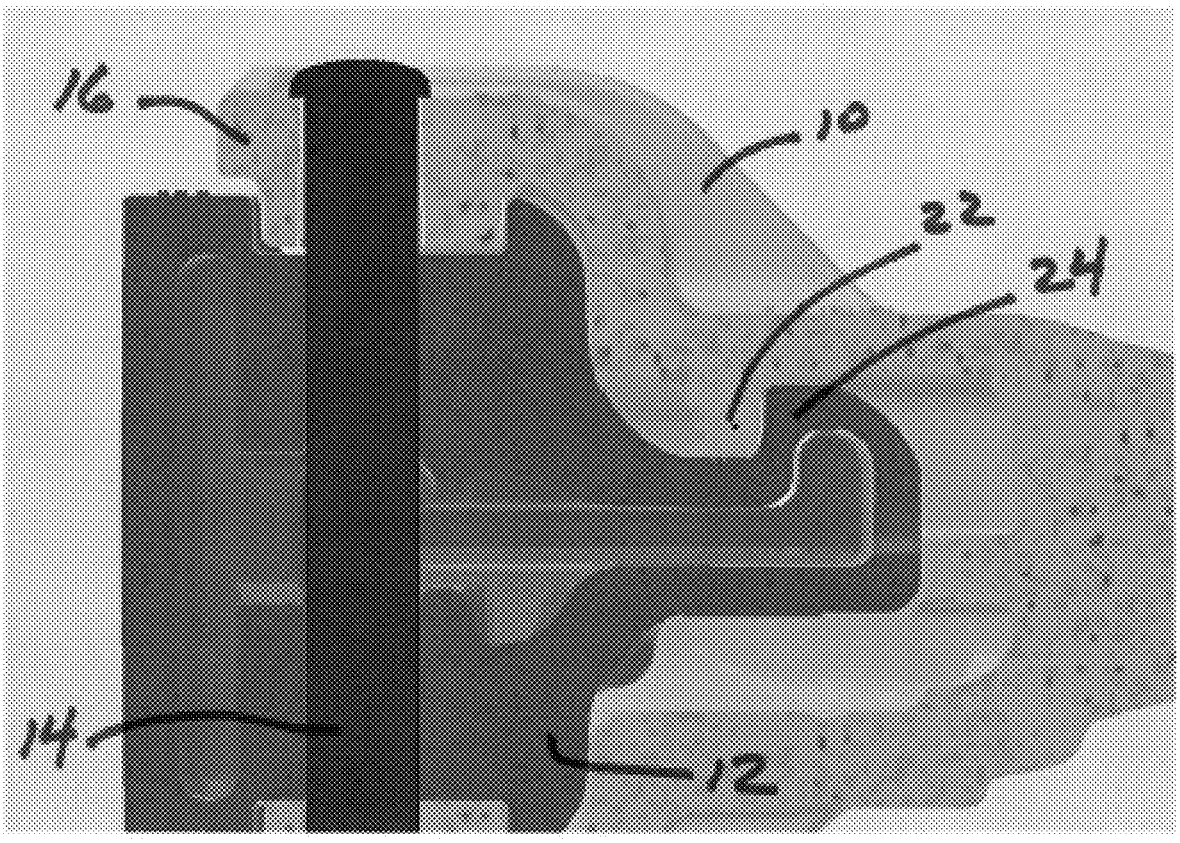
FIG. 2 shows a typical unworn top pulling lug, pin and pin protector.

FIGS. 1 and 2 show a coupler 10 having a knuckle 12 pivotally connected thereto. As shown more clearly in FIG. 2, the knuckle 12 is pivotally connected via a pin 14 extending through a pin protector 16 on the coupler 10. The pin protector 16 comprises an aperture formed in the coupler 10 to receive the pin 14. The coupler 10 has a shank 11 leading to a head 13. The shank 11 is an elongate structure having a longitudinal axis 15. The head 13 is shaped to receive a knuckle 12 and facilitate a mechanical connection or engagement between the coupler 10 and the knuckle 12. For instance, the coupler 10 has a recessed formation while the knuckle 12 has a protruding formation, wherein the protruding formation is received by the recessed formation. The profile of the recessed formation matches or at least complements the protruding formation so as to facilitate the mechanical connection or engagement. In particular, the coupler 10 has a coupler bottom pulling lug 18 that is a formation extending upward perpendicularly to the longitudinal axis 15, and the knuckle 12 has a knuckle bottom lug 20 that is a formation extending downward perpendicularly to the longitudinal axis 15. When the coupler 10 receives the knuckle 12, the knuckle bottom lug 20 resides within a pocket of the coupler 10 so that the knuckle bottom lug 20 is at least partially enveloped by the coupler bottom pulling lug 18. In addition, the coupler 10 has a coupler top pulling lug 22 that is a formation extending downward perpendicularly to the longitudinal axis 15, and the knuckle 12 has a knuckle top lug 24 that is a formation extending upward perpendicularly to the longitudinal axis 15. When the coupler 10 receives the knuckle 12, the knuckle top lug 24 resides within a pocket of the coupler 10 so that the knuckle top lug 24 is at least partially enveloped by the coupler top pulling lug 22. With this configuration, any motion of the knuckle 12 (or the coupler 10) along the longitudinal axis 15 will cause transfer of moments to the coupler 10 (or the knuckle 12) via mechanical contact or engagement between 8 and 20 and/or between 22 and 24.

Referring to FIG. 1, the coupler 10 includes a coupler bottom pulling lug 18 which engages with a knuckle bottom lug 20 on the knuckle 12. With a new (non-worn) coupler 10, as shown in FIG. 1, the space between the coupler bottom pulling lug 18 and the coupler bottom lug 20 will be virtually zero. During a draft event, the knuckle bottom lug 20 will move toward and engage the coupler bottom pulling lug 18. This is desired, as the coupler bottom pulling lug 18 is designed to withstand the heavy loads exerted thereon during a draft event.

Referring to FIG. 2, the coupler 10 includes a coupler top pulling lug 22 which engages with a knuckle top lug 24 on the knuckle 12. With a new coupler 10, as shown in FIG. 12 the space between the coupler top pulling lug 22 and the knuckle top lug 24 will be virtually zero. During a draft event, the knuckle top lug 24 will move toward and engage the coupler top pulling lug 22. This is desired, as the coupler top pulling lug 22 is designed to withstand the heavy loads exerted thereon during a draft event.

The coupler top 22 and coupler bottom 18 pulling lugs are designed to be initially loaded during a draft event. Thus, the space(s) between the coupler top 22 and coupler bottom 18 pulling lugs and the knuckle top 24 and knuckle bottom 20 lugs, respectively, will be virtually zero and, in any event, will be less than the space(s) between the coupler/knuckle interfaces, e.g., the pin 14 and pin protector 16 and the pin protector 16 and the knuckle 12. Thus ensures that the coupler top 22 and coupler bottom 18 pulling lugs are loaded first. In other words, the forces transmitted between the coupler 10 and knuckle 12 occur at interface 18/20 and interface 22/24 before occurring at any other interface. In some embodiments, the forces transmitted between the coupler 10 and knuckle 12 occur at the interface 18/20 and interface 22/24 without occurring at any other interface. In some embodiments, most of the forces transmitted between the coupler 10 and knuckle 12 occur at the interface 18/20 and interface 22/24.

Figure 3:
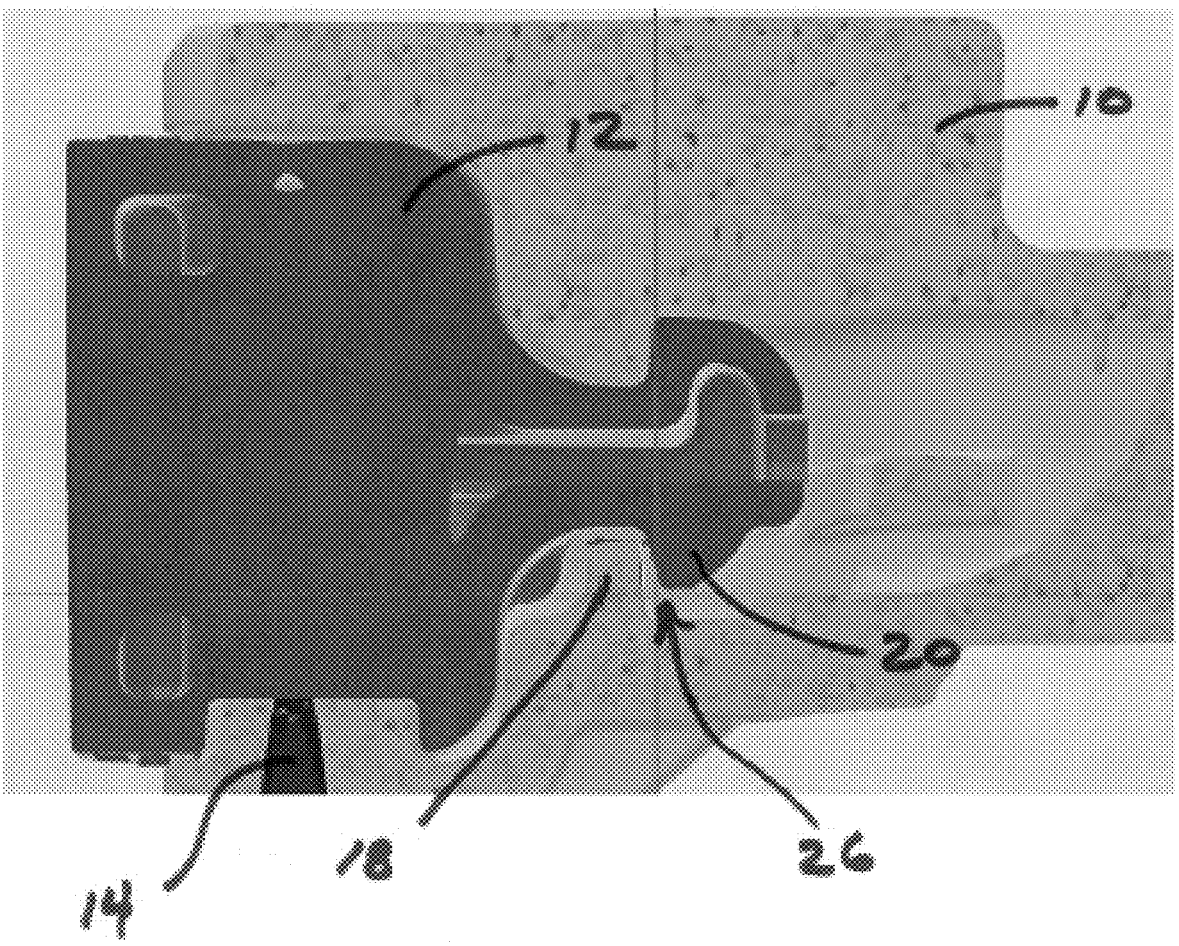
FIG. 3 shows a worn bottom pulling lug.
Figure 4:
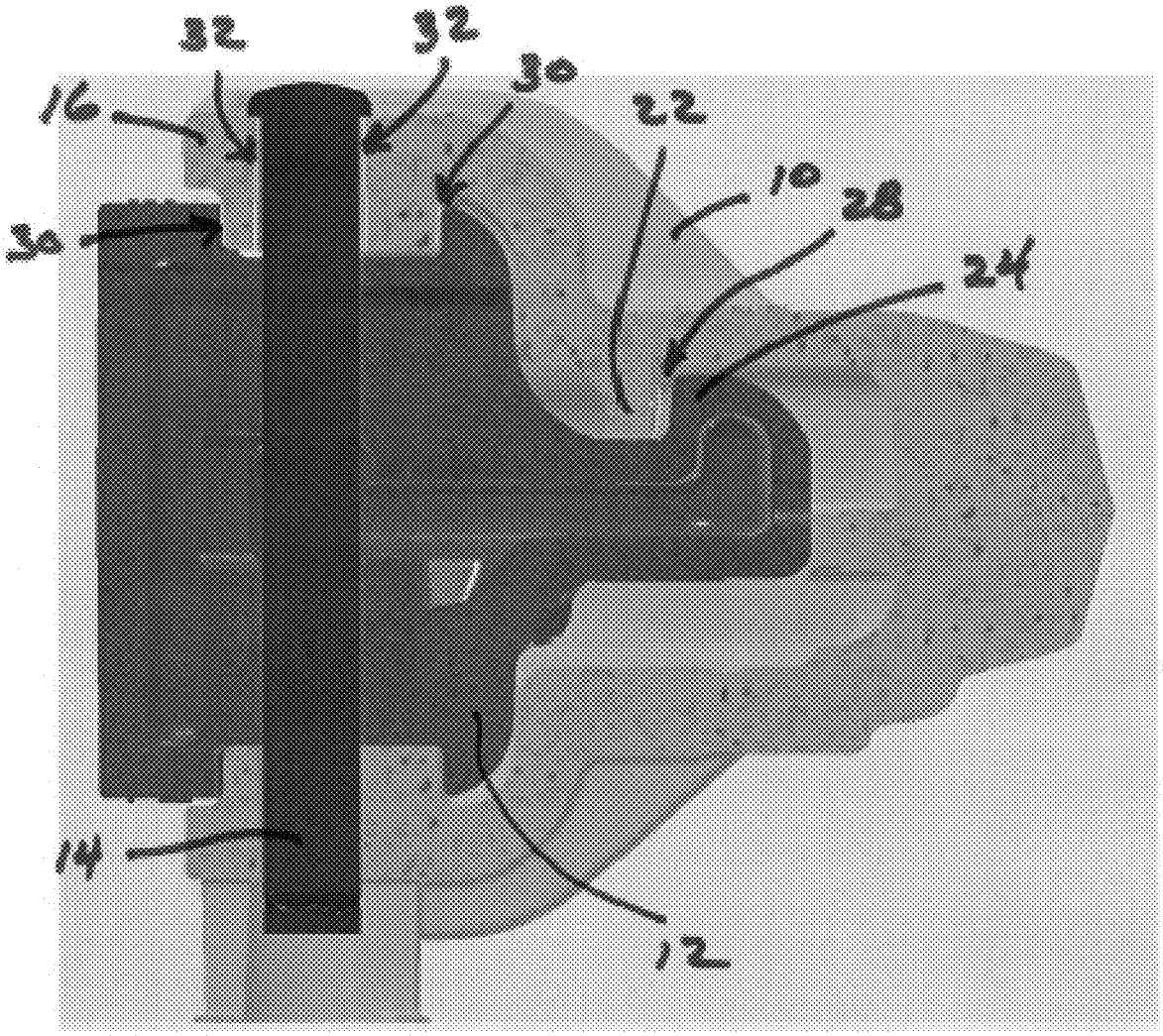
FIG. 4 shows a worn top pulling lug.

Over time, the coupler top 22 and coupler bottom 18 pulling lugs will wear, wherein a gap 28 will form between the coupler top pulling lug 22 and the knuckle top lug 24, and a gap 26 will form between the coupler bottom pulling lug 18 and the knuckle bottom lug 20—i.e., the surface(s) of the coupler top/bottom pulling lugs 22, 18 will wear such that the spaces will increase and gaps 28, 26 will form. For instance, the coupler bottom pulling lug 18 will wear such that the space will increase to form a gap 26 between the coupler bottom pulling lug 18 and the knuckle bottom lug 20. This gap 26 allows for undesired play between the knuckle 12 and coupler 10. Similarly, coupler top pulling lug 22 will wear such that space will increase to form a gap 28 between the coupler top pulling lug 22 and the knuckle top lug 24. This gap 28 also allows for undesired play between the knuckle 12 and coupler 10. Undesired play leads to additional wear, cracking, and/or mechanical fatigue on the coupler top 22 and coupler bottom 18 pulling lugs. FIG. 3 shows a gap 26 formed between the coupler bottom pulling lug 18 and the knuckle bottom lug 20. FIG. 4 shows a gap 28 formed between the coupler top pulling lug 20 and the knuckle top lug 24. When this occurs, the coupler top 22 and coupler bottom 18 pulling lugs will not be initially loaded. Instead, the loading will initially occur at the other interfaces of the coupler 10 and knuckle 12, such as the interface between the pin protector 16 and knuckle 12 (e.g., at interface 30) and the interface between the pin 14 and pin protector 16 (e.g., at interface 32). Additionally, loading also is exerted on the pin 14 itself. Since these components of the knuckle 12 are not designed for heavy loading, failure often occurs. The pin 14 and pin protector 16 are two points where breakage often occurs leading to coupler 10 failure. Thus, in addition to the exacerbated stress and strain imposed on the coupler top 22 and coupler bottom 18 pulling lugs, undesired stress and strain is imposed on other components of the knuckle 12 and/or coupler 10. These components are not intended, and thus not designed, to handle such loads. When these components are subjected to such loads, failure ensues quickly.

Current methods of reconditioning couplers 10 are deficient in that they do not address the wear of the coupler top 22 and coupler bottom 18 pulling lugs. Instead, the other components of the coupler 10 are reconditioned, whereby the worn coupler top 22 and coupler bottom 18 pulling lugs are not addressed. Thus, any gap 28 that resulted between the coupler top pulling lug 22 and knuckle top lug 24, or gap 26 that results between the coupler bottom pulling lug 18 and the knuckle bottom lug 20 will remain in a coupler 10 reconditioned in accordance with prior art methods. During a draft event, loading, which was originally was designed to be exerted on the coupler top 22 and coupler bottom 22 pulling lugs, will occur at the other coupler/knuckle interfaces (e.g., at the pin and/or pin protector—at interfaces 30 and 32). Such uneven loading, even with a reconditioned coupler 10, will again result in reduced coupler 10 life.

The inventive method involves applying a weldment to the worn areas of the coupler top 22 and coupler bottom 18 pulling lugs so as to reduce the gaps 28, 26 such that the spacings are at or near their original distances (original being before wearing occurred). For instance, the wear formed in the coupler bottom pulling lug 18 that gives rise to gap 26 can be filled in (e.g., the volume of space of the wear is built-up or filled in) with weldment. Similarly, the wear formed in the coupler top pulling lug 22 that gives rise to gap 28 can be filled in (e.g., the volume of space of the wear is built-up or filled in) with weldment. The weldment can be generated via gas welding, resistance welding, arc welding, solid state welding, etc. Material selection of the weldment can be based on the material properties of the knuckle 12 and coupler 10 such that the weldment can exhibit a desired strength and/or hardness. This desired strength and/or hardness can be less than, equal to, or greater than that of the knuckle 12 or coupler 10. Sometimes a trade-off between strength and hardness can be used in the selection process, as hardness tends to be better for wear but strength tends to be better for impact resistance.

In accordance with the inventive method, when a coupler 10 is brought in for reconditioning, it is initially sand blasted and then visually inspected for broken and/or cracked coupler top 22 or coupler bottom 18 pulling lugs. If a coupler top 22 or coupler bottom 18 pulling lug is broken, it will generally be scrapped. Cracks are typically arc washed for removal, and any other defects are retained and included in the welding process. The coupler 10 is put through a reconditioning process including welding, grinding, gauging, heat treat, blasting and final inspection. In accordance with the inventive method, the reconditioning process also includes the process of welding and gauging the coupler top 22 and coupler bottom 18 pulling lug. The thickness of the worn coupler top 22 or coupler bottom 22 pulling lug is determined, generally using a pulling lug gauge 34.

In exemplary implementation of the inventive method involves determining an amount of wear to a coupler top 22 or coupler bottom 12 pulling lug. This can include determining an amount of wear to any one or combination of the coupler bottom pulling lug 18 or the coupler top pulling lug 22. The amount of wear for the coupler bottom pulling lug 18 corresponds to the gap 26 formed between the coupler bottom lug 18 and the knuckle bottom lug 20. As the space between the coupler bottom lug 18 and the knuckle bottom lug 20 is initially zero or close to zero, the increase in spacing leading to the gap 26 is due to wear of the surface of the coupler bottom pulling lug 18 that makes contact with the surface of knuckle bottom lug 20. Similarly, the amount of wear of the coupler top pulling lug 22 corresponds to the gap 28 formed between the coupler top pulling lug 22 and the knuckle top lug 24. As the space between the coupler top pulling lug 22 and the knuckle top lug 24 is initially zero or close to zero, the increase in spacing leading to the gap 28 is due to wear of the surface of the coupler top pulling lug 22 that makes contact with the surface of knuckle top lug 24. The wear of the surface(s) of the coupler bottom 18 and/or coupler top 22 pulling lugs can be determined using a gauge 34.

Figure 9:
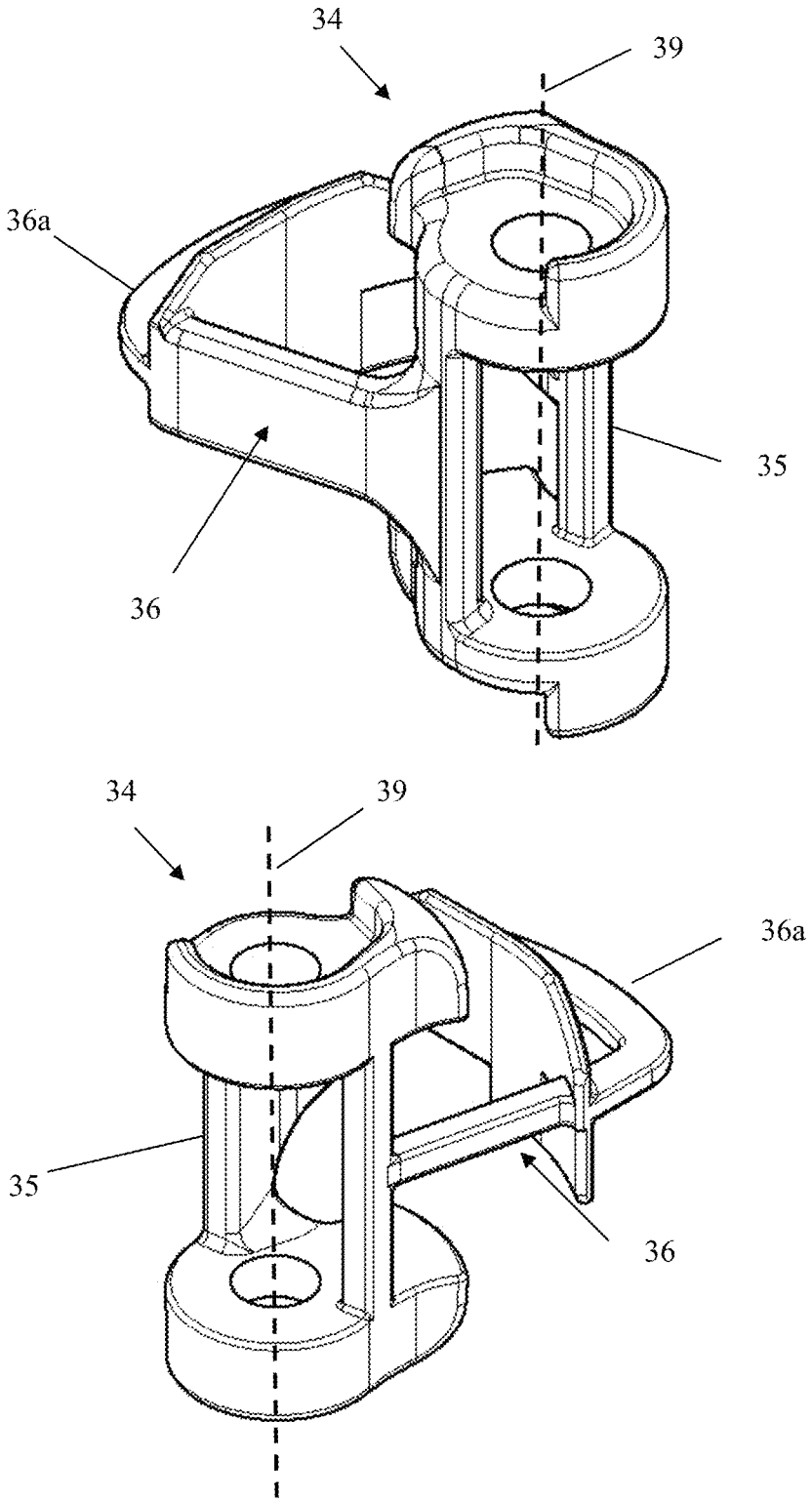
FIG. 9 shows a gauge for assessing whether weldment applied to a coupler lug is sufficient.

The gauge 34 includes a mandrel structure 35 having a spindle 37 extending therefrom, wherein the mandrel structure 35 and spindle 37 form a gauge axis 39. To use the gauge 34, the pin 14 in the coupler 10 is removed from the pin protector 16. The spindle 37 is inserted through the aperture of the pin protector 16 so that the mandrel structure 35 is allowed to rotate freely about an axis of the spindle 37. The mandrel structure 35 includes a measurement element 36 extending perpendicularly from the mandrel structure 35. When the gauge 34 is inserted into the coupler 10, rotation of the gauge 34 causes the measurement element 36 to follow an arc path. As shown in FIG. 9, the measurement element 36 has a guide plate **36*a* that is an arcuate member. The arcuate shape of the guide plate 36*a* mimics the shape or profile of the knuckle 12**.

Alternatively, the measurement element 36 can be a rod having a fixed length or a dial rod (e.g., rotating the rod allows the rod to extend or contract in length). For example, the dial rod can include an inner rod and outer rod connected via a threaded engagement, wherein rotating one relative to the other can cause the rod to extend or contract. The dial rod may include makings on one of the rods that provide an indication of the full length of the rod. The dial rod can also include a tensioner to facilitate cessation of relative rotational movement. For instance, one might set the dial rod to a desired length and use the tensioner to prevent further rotation so as to maintain that length. A user can then release the tensioner to allow for length adjustment if desired.

When inserted into the coupler 10, the gauge 34 can be rotated so that a distal end of the measurement element 36 makes contact with the coupler top pulling lug 22 or the coupler bottom pulling lug 18. This may require adjustment of the length of the measurement element 36 (if it is adjustable). This is done for a new coupler 10 (before it is worn). The length of the measurement element 36 can be fixed so that the distal end of the measurement element 36 makes contact with the coupler top pulling lug 22 or the coupler bottom pulling lug 18. Alternatively, the length of the measurement element 36 can be adjusted to cause the distal end of the measurement element 36 to make contact with the coupler top pulling lug 22 or the coupler bottom pulling lug 18, wherein the length is then measured. After wear occurs to the coupler top pulling lug 22 or the coupler bottom pulling lug 18, the gauge 34 (with the fixed length measurement element 36 or having an adjustable one in which the length is adjusted to the previously measured length), is inserted again to assess the amount wear. The amount of wear can be assessed by visually observing a gap 26, 28 or the amount of wear can be measured by adjusting the length of the measuring element 36 so it makes contact again and taking a difference of measurements.

Alternatively, the amount of wear can be assessed using a feeler gauge, as opposed to gauge 34. A feeler gauge can be a simple pin gauge, for example. In either case, gauge 34 can be used to assess whether the amount of weldment applied is sufficient so reduce or eliminate the gap 26, 28. Thus, the filer gauge or gauge 34 can be used to assess the amount of wear, and gauge 34 can be used to assess whether the amount of weldment applied is sufficient so reduce or eliminate the gap 26, 28.

After the amount of wear is assessed, feeler gauge or gauge 34 is removed, and a weld operation can be performed to build up the wear surface(s). Alternatively, gauge 34 (if gauge 34 is used) can be rotated so that the measuring element 34 is not adjacent the wear surface(s) but the gauge 34 is left engaged with the coupler 10. Applying weldment via welding results in a reconditioned coupler 10'.

After reconditioning, gauge 34 can be inserted (or in some cases re-inserted) to determine whether the weld 40, 38 sufficiently built up the lugs 22', 18' (e.g., the gap 26, 28 has been reduced to zero or near zero). If not, additional weldment can be applied. Sufficient weldment is applied when the distal end of the measuring element 34 makes contact with the lug 22', 18' but still allows for free rotation of the gauge 34 about its axis 39 or barely makes contact with the lug 22', 18' and allows for free rotation of the gauge 34 about its axis 39.

Figure 8:
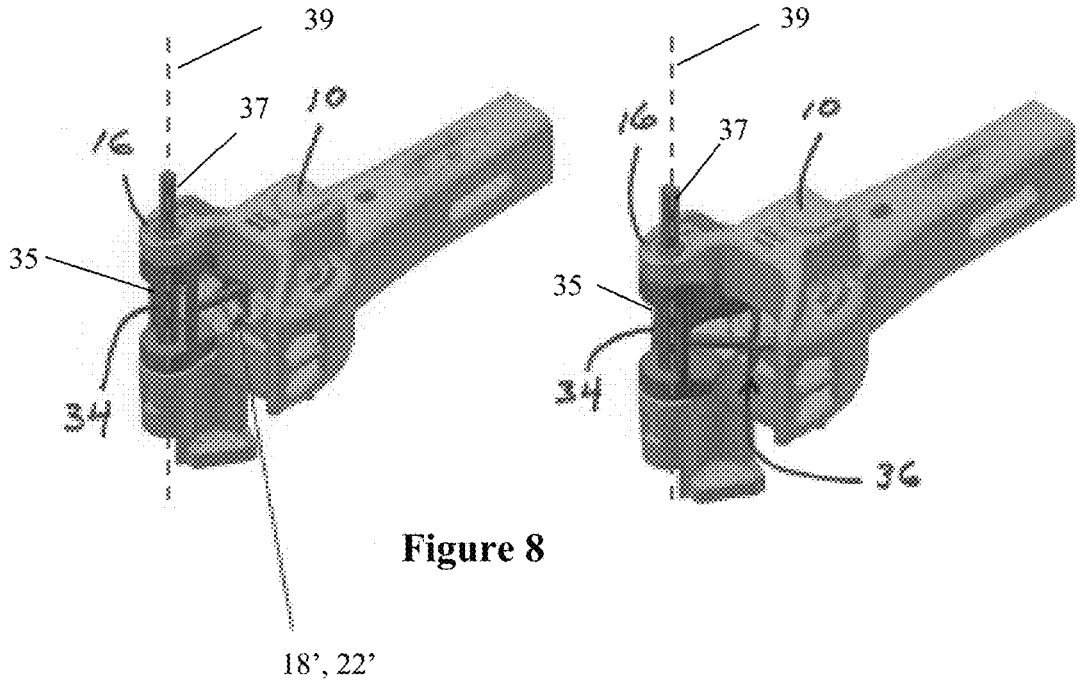
FIG. 8 shows a coupler with a pulling lug gauge in closed and open positions.

The gauge 34 can also be used to assess whether too much weldment has been applied. As can be seen in FIG. 8, the gauge 34 can be rotated to and from closed and open positions. The closed position is shown in the drawing on the left side of FIG. 8 and the open position is shown in the drawing on the right side of FIG. 8. As the guide plate 36*a* in the embodiment shown in FIG. 9 is shaped to mimic the knuckle 12, it should (if the weldment on the lugs 22', 18' are properly applied) rotate with full range of motion between the closed and open positons. If so, then it can be determined that the weldment applied to lugs 22', 18' is not too much (e.g., the weldment does not produce an obstruction to the full range of motion). The full range of rotational motion of the gauge 34 can be the same full range of motion of the knuckle 12. If too much weldment is applied, it will cause an obstruction and will hinder or prevent full range of rotation.

After sufficient weldment is applied, the surface(s) can be grinded to provide a desired profile or surface finish. It is contemplated for the profile of the coupler top pulling lug 22' to match, or at least complement, that of the knuckle top lug 24, and the profile of the coupler bottom pulling lug 18' to match, or at least complement, that of the knuckle bottom lug 20.

The method can further involve heat treatment or other conditioning of the coupler 10', and in particular the new weld and/or area of the coupler 10' near the new weld. This can be done to provide a desired material property (e.g., hardness, strength, etc.). An exemplary heat treatment process can be as follows. It is contemplated for all Grade C castings to be quenched and tempered to Grade E. The product (the coupler and weld) is heated in a furnace to 1650° F. throughout the product's entire volume and held at this temperature for a minimum of 30 minutes. However, the furnace temperature should not be above 800° F. when the product is charged into furnace. The product is them removed from the furnace and, in less than 1 minute, completely submerge them in moving or agitated water that is maintained between 55° F. and 150° F. at start of the quench, with a preferred range of 55° F. to 75° F. The product is held under water until cooled below 400° F. The product removed from the water and, as soon as possible, it is furnace heated to 1010-1030° F. The product is held at this temperature for a minimum of 2 hours. A higher temperature may be necessary to attain a desired hardness. The product must be re-quenched and tempered if it is too soft and re-tempered if it is too hard. The product should be tempered as soon as possible to prevent cracking. In no case should the time between quenching and tempering exceed 8 hours. The product is cooled in static shop air or quench immediately after tempering of quenched and tempered material.

The method can further involve finishing (e.g., sand blasting, polishing, burnishing, etc.) of the new weld and/or area of the coupler 10' near the new weld.

The method can further involve a final inspection of inserting feeler gauge or gauge 34 back into the coupler 10' and assessing whether any gap 26, 28 remains or whether a gap 26, 28 remains but is at an acceptable level. For instance, it may be acceptable to have a gap 26, 28 but for the gap to be below a predetermined distance.

After final inspection, feeler gauge or gauge 34 is removed and the pin 14 is reinserted.

FIG. 8 shows the coupler 10 with a pulling lug gauge 34 in closed (left) and open (right) positions. The gauge 34 is received in the pin protector 16 in place of the pin 14. The gauge 34 is then pivoted between closed (left) and open (right) positions to determine the wear of the coupler top 22 or coupler bottom 18 pulling lugs. The gauge 34 includes a measurement element 36 that travels in the same arc as the knuckle top 24 and knuckle bottom 20 lugs. When in the closed position (left) the gap 28, 26 between the coupler top 22 and coupler bottom 18 pulling lug surface and the measurement element 36 can be determined. The gap represents the amount of weld 40 that needs to be applied to the coupler top 22 or coupler bottom 18 pulling lug to bring its thickness back up to its original thickness such that loading during a draft event will initially occur on the coupler top 22 or coupler bottom 22 pulling lug.

Figure 5:
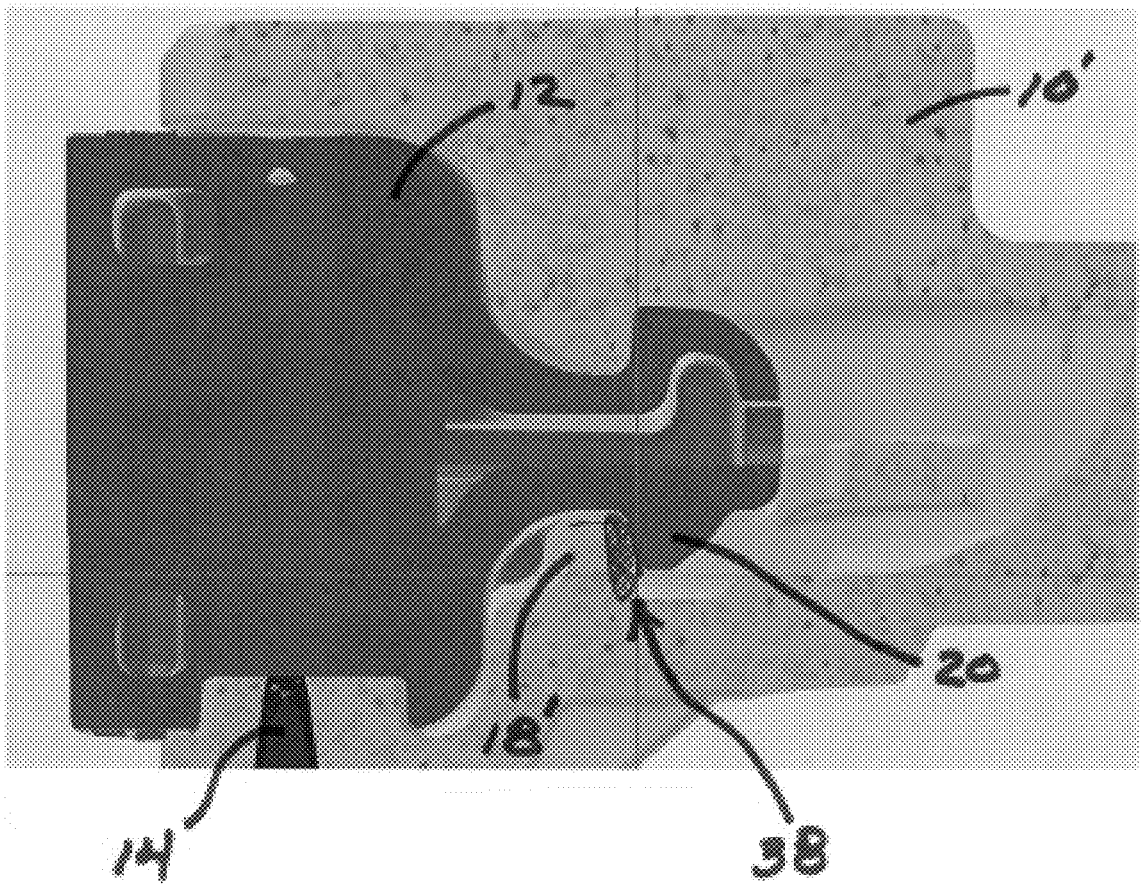
FIG. 5 shows a reconditioned bottom pulling lug reconditioned in accordance with the inventive method.

FIG. 5 shows a reconditioned coupler 10' having a coupler bottom pulling lug 18' reconditioned in accordance with the inventive method. A weld, shown at 38, is applied to the surface of the coupler bottom pulling lug 18' which engages the knuckle bottom lug 20. The weld 38 increases the thickness of the coupler bottom pulling lug 18' back to its original thickness, or very close thereto. Obviously the amount of the weld 38 will vary depending on the wear of the coupler bottom pulling lug 18. The pulling lug gauge 34 (see FIG. 8) can be used to determine when enough weld 38 has been applied to increase the thickness of the coupler bottom pulling lug 18' to its original thickness. The measurement element 36 passing snug against the coupler bottom pulling lug 18' or very close thereto, is an indication that the weld 38 has brought the coupler bottom pulling lug 18' back or close to its original thickness. The coupler bottom pulling lug 18' will then be initially engaged by the knuckle bottom lug 20 during a draft event. This is desired and intended for even loading and increased coupler 10' life.

Figure 6:
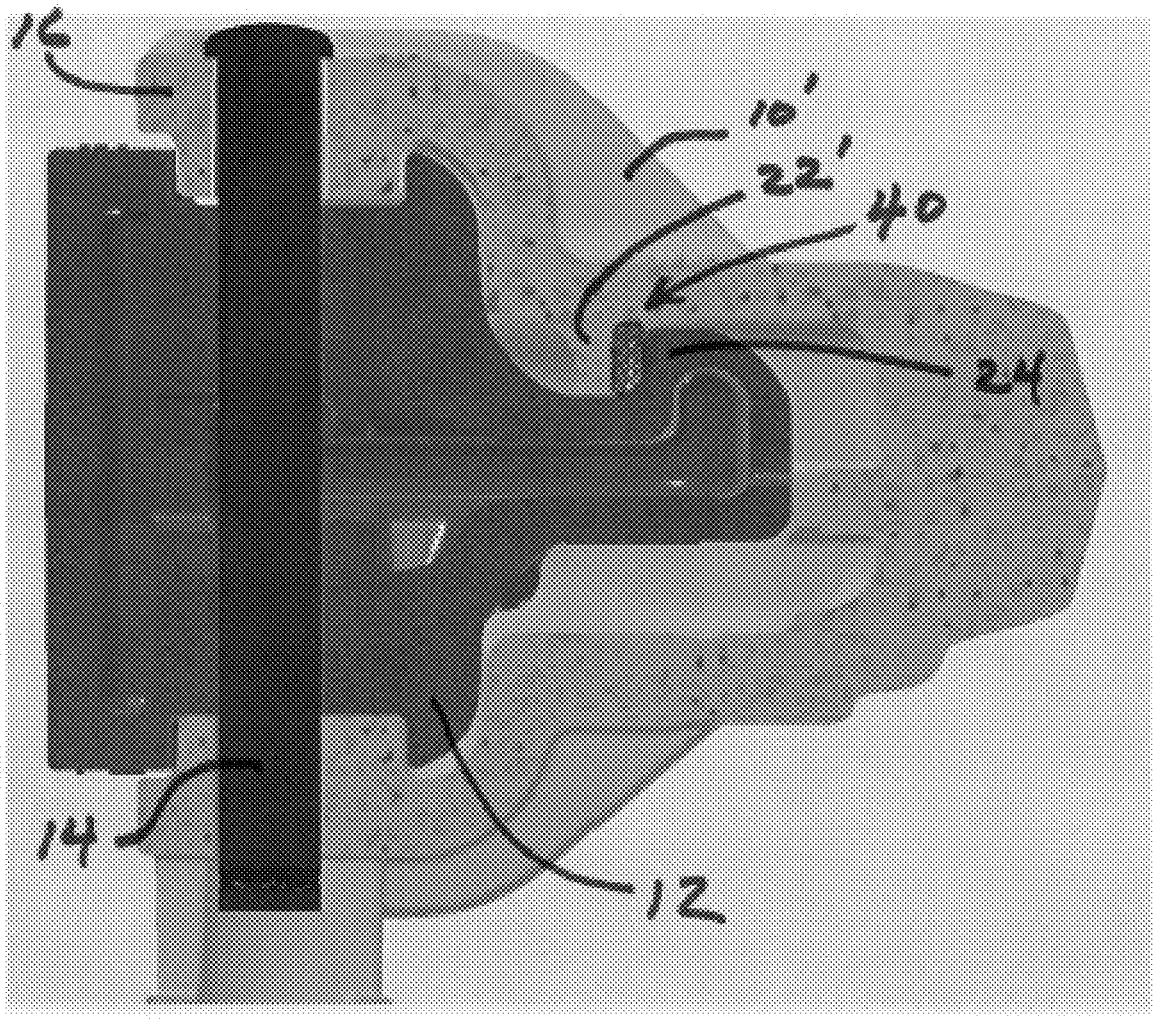
FIG. 6 shows a reconditioned top pulling lug reconditioned in accordance with the inventive method.
Figure 7:
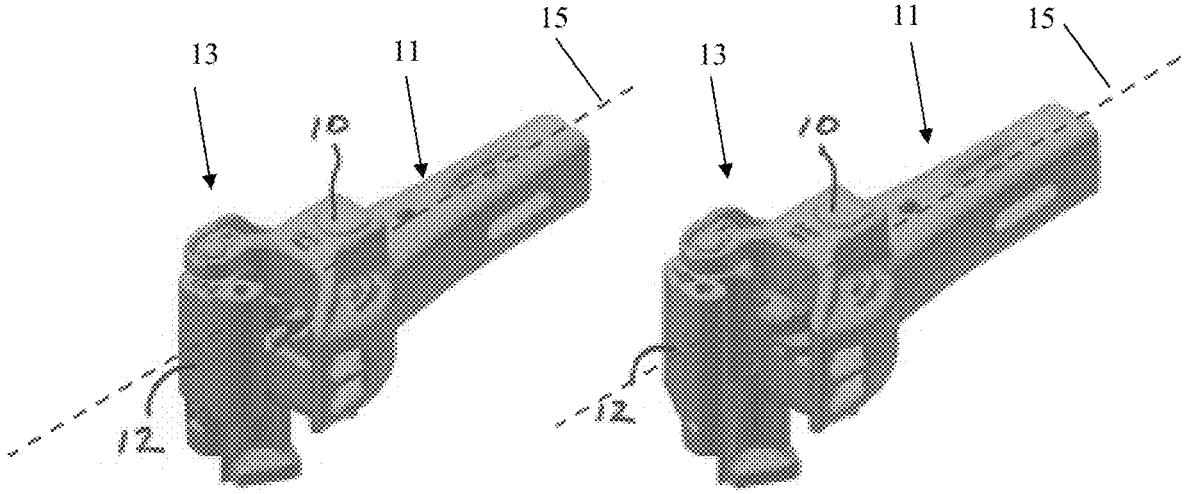
FIG. 7 shows a coupler with a knuckle in closed and open positions.

FIG. 6 shows a reconditioned coupler 10' having a coupler top pulling lug 22' reconditioned in accordance with the inventive method. A weld, shown at 40, is applied to the surface of the coupler top pulling lug 22' which engages the knuckle top lug 24. The weld 40 increases the thickness of the coupler top pulling lug 22' back to its original thickness, or very close thereto. Obviously the amount of the weld 40 will vary depending on the wear of the coupler top pulling lug 22. The pulling lug gauge 34 (see FIG. 8) can be used to determine when enough weld 40 has been applied to increase the thickness of the coupler top pulling lug 22' to its original thickness. The measurement element 36 passing snug against the coupler top pulling lug 22' or very close thereto, is an indication that the weld 40 has brought the coupler top pulling lug 22' back or close to its original thickness. The coupler top pulling lug 22' will then be initially engaged by the knuckle top lug 24 during a draft event. This is desired and intended for even loading and increased coupler 10' life.

In welding the coupler top 22 and coupler bottom 18 pulling lugs, grinders are typically used to clean the surfaces behind the coupler top 22 and coupler bottom 18 pulling lugs where the weld 40, 38 will be applied. After cleaning, the feeler gauge or gauge 34 can be used to determine the amount of top 22 or bottom 18 pulling lug wear (e.g., how much of a gap 28, 26 formed) and how much weld 40 38 will be required. In one form, the weld 40, 38 wire could be 125-K4m and the carbon arc wash rod can be 5/16-inch in diameter.

It is understood that while embodiments disclosed herein describe and illustrate conditioning the coupler 10, conditioning the knuckle 12 can also occur. Thus, the inventive method can be applied equally to the knuckle 10 as to the coupler 10. For instance, weldment can be applied to the knuckle top lug 24 and/or knuckle bottom lug 20 if any of them experience wear. Also, weldment can be applied to a coupler lug 18, 22 and/or a knuckle lug 20, 24 to provide the desired interface between the two components. In addition, even if wear only occurs on the coupler lug 18, 22 (or the knuckle lug 20, 24), weldment can be applied to the knuckle lug 20, 24 (or the coupler lug 18, 22) so that the build-up on the knuckle 12 (or coupler 10) accommodates the wear on the coupler lug 18, 22 (or knuckle lug 20, 24).

It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features, or parts of other embodiments. The elements and acts of the various embodiments described herein can therefore be combined to provide further embodiments.

It is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of the method of reconditioning couplers 10' have been discussed and illustrated herein, it is to be distinctly understood that the invention is not limited thereto but may be otherwise variously embodied and practiced within the scope of the invention.

LIST OF REFERENCE NUMBERS

10 coupler
10' reconditioned coupler
11 shank
12 knuckle
13 head
14 pin
15 longitudinal axis
16 pin protector
18 bottom pulling lug (coupler)
18' reconditioned bottom pulling lug (coupler)
20 bottom lug (knuckle)
22 top pulling lug (coupler)
22' reconditioned top pulling lug (coupler)
24 top lug (knuckle)
26 bottom gap
28 top gap
30 interface—pin protector/knuckle
32 interface—pin/pin protector
34 pulling lug gauge
35 mandrel structure
36 gauge measuring element
**36*a*** guide plate
37 spindle
38 weld—bottom
39 gauge axis
40 weld—top

What is claimed is:

1. A method for reconditioning a railcar coupler comprising:

determining an amount of wear to a coupler pulling lug using a gauge;

cleaning a surface of the coupler pulling lug experiencing the wear;

applying a weldment to the surface of the coupler pulling lug experiencing the wear to increase the thickness of the coupler pulling lug;

wherein the gauge comprises a mandrel structure, a spindle, and a measurement element, the method further comprises:

inserting the gauge into the railcar coupler so that the spindle inserts into a pin protector of the railcar coupler; and rotating the gauge so that the measurement element traverses an arc path across the coupler pulling lug.

2. The method of claim 1, further comprising:

using a gauge to assess whether the weldment applied increases the thickness to an amount less than, equal to, or greater than the wear experienced by the coupler pulling lug.

3. The method of claim 2, wherein the gauge comprises a mandrel structure, a spindle, and a measurement element, the method further comprises:

inserting the gauge into the railcar coupler so that the spindle inserts into a pin protector of the railcar coupler;

rotating the gauge so that the measurement element traverses an arc path across the coupler pulling lug.

4. The method of claim 3, wherein:

the measuring element includes a fixed length rod or a dial rod having an adjustable length.

5. The method of claim 3, wherein:

the measuring element includes guide plate, the guide plate being an arcuate member.

6. The method of claim 1, further comprising:

grinding the weldment applied to the coupler pulling lug.

7. The method of claim 6, further comprising:

grinding the weldment applied to the coupler pulling lug so that a profile of the coupler pulling lug complements a profile of a knuckle lug.

8. The method of claim 1, wherein:

the amount of weldment applied to the coupler pulling lug is equal to the amount of wear experienced by the coupler pulling lug.

9. The method of claim 1, wherein the railcar coupler includes a coupler top pulling lug and a coupler bottom pulling lug, the method further comprising:

determining, using a gauge, an amount of wear to the coupler top pulling lug and an amount of wear the coupler bottom pulling lug;

cleaning a surface of the coupler top pulling lug experiencing the wear;

cleaning a surface of the coupler bottom pulling lug experiencing the wear;

applying weldment to the surface of the coupler top pulling lug experiencing the wear to increase the thickness of the coupler top pulling lug; and applying weldment to the surface of the coupler bottom pulling lug experiencing the wear to increase the thickness of the coupler bottom pulling lug.

10. The method of claim 1, further comprising:

heat treating the weldment applied to the coupler pulling lug.

11. The method of claim 1, further comprising: using a distance between the measurement element and the coupler pulling lug as an indicator of the amount of wear experienced by the coupler pulling lug.

12. The method of claim 1, further comprising:

removing the gauge before applying weldment; or rotating the measuring element so as to not be adjacent to the surface of the coupler pulling lug experiencing the wear before applying weldment.

13. The method of claim 1, wherein:

the measuring element includes a fixed length rod or a dial rod having an adjustable length.

14. The method of claim 1, wherein:

the measuring element includes guide plate, the guide plate being an arcuate member.

* * * * *